US005784944A

United States Patent [19]

Tozawa et al.

[11] Patent Number: 5,784,944

[45] Date of Patent: Jul. 28, 1998

[54] DEVICE AND METHOD FOR CONTROLLING ATTACHMENT OF CONSTRUCTION MACHINE

[75] Inventors: Shoji Tozawa; Tomoaki Ono, both of Hyogo, Japan

[73] Assignee: Shin Caterpillar Mitsubishi Ltd., Tokyo, Japan

[21] Appl. No.: 679,576

[22] Filed: Jul. 15, 1996

[51] Int. Cl.[6] ..... F15B 13/16; F15B 13/044

[52] U.S. Cl. ..... 91/361; 91/459; 91/461

[58] Field of Search ..... 91/459, 461, 361, 91/511, 403, 410

[56] References Cited

U.S. PATENT DOCUMENTS

| | | | |
|---|---|---|---|
| 2,235,809 | 8/1941 | Farrell | 91/461 X |
| 4,194,365 | 3/1980 | Stoufflet et al. . | |
| 5,062,264 | 11/1991 | Frenette et al. | 91/461 X |
| 5,383,390 | 1/1995 | Lukich | 91/361 |
| 5,477,770 | 12/1995 | Ono et al. . | |
| 5,497,805 | 3/1996 | Sunamura et al. | 91/461 X |

FOREIGN PATENT DOCUMENTS

| | | |
|---|---|---|
| 0125736 | 5/1984 | European Pat. Off. . |
| 0652377 | 9/1994 | European Pat. Off. . |
| 7719309 | 6/1977 | France . |
| 2827449 | 6/1978 | Germany . |
| 5410870 | 6/1978 | Japan . |
| 59-213824 | 5/1983 | Japan . |
| 59-213825 | 5/1983 | Japan . |
| 59-213826 | 5/1983 | Japan . |
| 3110223 | 5/1991 | Japan . |
| 7103206 | 9/1993 | Japan . |
| 2000326 | 6/1978 | United Kingdom . |

*Primary Examiner*—Hoang Nguyen
*Attorney, Agent, or Firm*—Morrison Law Firm

[57] ABSTRACT

A control method and a device to control construction equipment attachments include during manual operation, the pilot pressure discharged from a pilot pump is fed from a manual operation valve through an electromagnetic change valve to a main control valve. During automatic operation, the pilot pressure from an automatic-mode selecting valve is fed through an electromagnetic proportional control valve as well as the electromagnetic change valve, all of which are controlled by a controller, to a main control valve. When the operation range is restrictively set during manual operation, the pilot pressure output from the manual operation valve is fed through the electromagnetic proportional control valve as well as the electromagnetic change valve to the main control valve. Both the main control valve and the electromagnetic proportional control valve are controlled by control signals from the controller. When the equipment attachment approaches the set restriction, the main control valve is returned to a neutral position by the controller causing the electromagnetic proportional control valve to block the pilot pressure.

6 Claims, 10 Drawing Sheets

DEVICE AND METHOD FOR CONTROLLING ATTACHMENT OF CONSTRUCTION MACHINE

BACKGROUND OF THE INVENTION

This invention relates to a control device and a control method for a mechanical linkage operated by hydraulics. In particular, this invention relates to a control device and a control method for an attachment of a construction machine.

When performing a straight-line excavation with a hydraulic shovel that is controlled by a hydraulic pilot operated control valve, the tooth tips of the hydraulic shovel's bucket are typically moved in a straight line in a semi-automatic mode. In such a mode, the equipment operator sets the path of movement into a computer which executes the path command automatically.

The computer is bypassed when the equipment is operated in a manual mode where the operator directly controls the hydraulics.

FIG. 9 shows a typical procedure of the prior art. As shown in FIG. 9, the position of an attachment linkage is detected by using a sensor attached to, for example, a joint of the attachment linkage. Control of the attachment conformation is maintained by a closed feedback loop through a microcomputer.

When the mode is switched between manual operation and automatic operation, of the straight-line excavation mode in this case, an on-off change valve is used to change the pilot pressure which operates a main control valve that controls a hydraulic cylinder.

Therefore, by setting the operating range of the attachment beforehand, the automatic mode is capable of preventing the equipment from advancing into the restricted operation area. This capability is an important safety function which limits the operating range of the attachment to the safe operating conformations. However, due to the configuration of the pilot pressure switching mechanism, it is difficult to include this safety function in the manual operation mode.

As a result, when an operator is manually operating the attachment, the operator must take care not to accidentally hit the attachment against structures or objects around the machine. Additionally, there is a danger of a damaging collision to the construction machine itself.

OBJECTS AND SUMMARY OF THE INVENTION

In order to solve the above problems, an object of the invention is to provide a device and a method to control an attachment of a construction machine to limit and control the operating range of the attachment, including during manual operation.

It is an object of the invention to provide a device and a method to control an hydraulically controlled mechanical linkage to limit and control the operating range of the linkage during automatic, semi-automatic, and manual operation.

It is an object of the invention to provide a device and a method to provide automatic control of the working range of a construction machine attachment, thereby preventing the machine as well as a building and other objects near the machine from being damaged due to possible carelessness of the operator, even when the machine is being operated manually.

It is an object of the invention to provide a device and a method to provide automatic control of the working range of a construction machine attachment, even during manual operation, suitable to such cases that require operating a construction machine such as a hydraulic shovel, a loader, or a back hoe at a small site which allows only a minimal working space, thereby preventing damage to the machine as well as to buildings and other objects.

According to an embodiment of the present invention, a construction machine attachment control device controls, by using pilot operated main control valves, the working fluid fed to hydraulic actuators that operate the attachment. The control device has manual operation valves for manually controlling the pilot pressure to be fed to the main control valves. The control device further has electromagnetic proportional control valves which are disposed in the pilot pressure feed line for manual operation. The electromagnetic proportional control valves are situated in the hydraulic fluid feed lines between the respective manual operation valves to the aforementioned main control valves. Thus, the electromagnetic proportional control valves are in the pilot lines, from the manual operation valves to the aforementioned main control valves, to feed pilot pressure during manual operation.

During manual operation, when the attachment approaches a restricted conformation, the device according to an embodiment of the present invention is capable of stopping the attachment in accordance with electrical signals independent of the operator's control. In this way, the attachment can be kept in the desired conformations of safe operation without the operator's attention.

The control device of the present invention controls the main control valves by controlling the electromagnetic proportional control valves with electrical signals. The electromagnetic proportional control valves electrically control the manual operation pilot pressure. Thus, the control device controls the manual operation pilot pressure. When the attachment approaches a restricted conformation, the control device puts the main control valves to the neutral position. With the main control valves in the neutral position, the attachment is motionless. As a result, the attachment is prevented from achieving a forbidden conformation.

The device is thus free from the danger of an operator accidentally hitting the attachment against a building or other nearby objects during manual operation of the equipment. Safe and easy manual operation is ensured.

According to another embodiment of the present invention, a construction machine attachment control device uses the pilot operated main control valves to control the working fluid fed to hydraulic actuators that operate the attachment. The attachment control device includes manual operation valves and an automatic-mode selecting valve. The manual operation valves manually control the pilot pressure fed to the main control valves by way of manual pilot lines that pass through the manual operation valves. The automatic-mode selecting valve selects other automatic pilot pressure feed lines when the attachment is automatically operated. The automatic pilot lines are separate from the aforementioned manual pilot lines. Electromagnetic proportional control valves, which proportionally open or close according to electric signals, control the pilot pressure fed from the manual operation valves or from the automatic-mode selecting valve. Other electromagnetic change valves select either the electromagnetic proportional control valves or the manual operation valves and output pilot pressures to the pilot chambers of the main control valves. A controller controls the automatic-mode selecting valve, the electromagnetic proportional control valves, and the electromagnetic change valves according to electric signals. Attachment sensors, which detect the distance moved by the attachment, input the information to the controller. Manual operation sensors, which detect conditions of manual operation by the manual operation valves, also input the information to the controller.

In the above embodiment, the present invention provides a construction machine attachment control device which is capable of three functions, (1) manual operation of the attachment; (2) control of the operation range of the attachment by means of the manual operation valves and the electromagnetic proportional control valves; and (3) automatic operation of the attachment attained by an automatic-mode selecting valve to connect automatic pilot pressure feed lines, which bypass the manual operation valves, to electromagnetic proportional control valves.

An important feature of the present invention is the operation range control mode wherein the attachment is automatically prevented, without any input from the operator, from advancing into the restricted space. In the operation range control mode, the controller automatically regulates the apertures of the electromagnetic proportional control valves. The changes in aperture is regulated according to electric signals from the controller so that the pilot pressure supplied from the manual operation valves is controlled independent of the operator. The present invention includes a fail-safe feature whereby, even if one or more electromagnetic proportional control valves fail, manual operation is possible using a combination of the manual operation valves, electromagnetic proportional control valves and electromagnetic change valves, because pilot pressure from the manual operation valves can be fed through the electromagnetic change valves to the main control valves.

According to another feature of the invention, a shuttle valve is provided between each manual operation valve and the automatic-mode selecting valve. The shuttle valve is capable of outputting the pilot pressure fed from either valve to the corresponding electromagnetic proportional control valve. The shuttle valve can be a simple low cost structure such as a three-way valve that is placed between a manual operation valve, an automatic operation mode selecting valve and an electromagnetic proportional control valve. Thus, the overall control circuit is simplified.

Another embodiment of the present invention provides a construction machine attachment control method to control, using pilot operated main control valves, the working fluid fed to hydraulic actuators which operate the attachment, wherein the pilot pressure which is fed to the manually operated main control valves is reduced when the attachment approaches a restricted operation area. Further, the pilot pressure to the main control valves is completely blocked when the attachment reaches the restricted operation area, thereby putting the main control valves to their respective neutral positions.

In the above embodiment, when the attachment approaches the restricted operation area, the pilot pressure fed to the manually controlled main control valves is reduced, thus causing the main control valves to start to return to their neutral positions. As a result, inertial load of the attachment is gradually braked by the gradual shifting of the main control valves to their neutral positions. Hence, when the attachment reaches the aforementioned restricted operation area, the control method according to the present invention is capable of smoothly stopping the attachment, thereby preventing vibrations, shocks, or other hazardous effects caused by the halting of the attachment.

Briefly stated, a control method and a device to control construction equipment attachments include during manual operation, the pilot pressure discharged from a pilot pump is fed from a manual operation valve through an electromagnetic change valve to a main control valve. During automatic operation, the pilot pressure from an automatic-mode selecting valve is fed through an electromagnetic proportional control valve as well as the electromagnetic change valve, all of which are controlled by a controller, to a main control valve. When the operation range is restrictively set during manual operation, the pilot pressure output from the manual operation valve is fed through the electromagnetic proportional control valve as well as the electromagnetic change valve to the main control valve. Both the main control valve and the electromagnetic proportional control valve are controlled by control signals from the controller. When the equipment attachment approaches the set restriction, the main control valve is returned to a neutral position by the controller causing the electromagnetic proportional control valve to block the pilot pressure.

According to an embodiment of the present invention, a method to control a mechanical linkage, using a pilot operated main control valve that controls a working fluid fed to a hydraulic actuator which operates the mechanical linkage, comprises sensing a configuration of the linkage, adjusting a pilot pressure of the working fluid fed to the pilot operated main control valve in response to the sensed configuration, and reducing the pilot pressure of the working fluid, to a zero pressure, to the pilot operated main control valve when the mechanical linkage reaches a predefined configuration, whereby the pilot operated main control valve assumes a neutral position wherein the mechanical linkage is halted.

According to an embodiment of the present invention, a device to control a mechanical linkage, using a pilot operated main control valve that controls a working fluid fed to a hydraulic actuator which operates the mechanical linkage, comprises means for sensing a configuration of the linkage, means for adjusting a pilot pressure of the working fluid fed to the pilot operated main control valve in response to the sensed configuration, and means for reducing the pilot pressure of the working fluid, to a zero pressure, to the pilot operated main control valve when the mechanical linkage reaches a predefined configuration, whereby the pilot operated main control valve assumes a neutral position wherein the mechanical linkage is halted.

According to another embodiment of the present invention, a method to control a mechanical linkage, using a pilot operated main control valve that controls a working fluid fed to a hydraulic actuator which operates the mechanical linkage, comprises storing a predetermined configuration of the linkage in a data processor, sensing a configuration of the linkage, comparing the configuration with the predetermined configuration, automatically reducing a pilot pressure of the working fluid fed to the pilot operated main control valve when the comparison of the predetermined configuration and the configuration of the linkage approaches a predefined value, and reducing, to a zero pressure, the pilot pressure of the working fluid supplied to the pilot operated main control valve when the mechanical linkage reaches the predefined configuration, whereby the pilot operated main control valve assumes a neutral position wherein the mechanical linkage is halted.

According to an embodiment of the present invention, a method to control a construction machine attachment, using a plurality of pilot operated main control valves that control a working fluid fed to a plurality of hydraulic actuators which operate the attachment, comprises sensing a configuration of the attachment, adjusting a pilot pressure of the working fluid fed to a plurality of manually operated main control valves in response to the sensed configuration, and reducing the pilot pressure of the working fluid, to a zero pressure, to the main control valves when the attachment has reached a predetermined configuration, whereby the main control valves assume their respective neutral positions, wherein the attachment is halted.

According to another embodiment of the present invention, a device to control a construction machine attachment, using a plurality of pilot operated main control valves that control a working fluid fed to a plurality of hydraulic actuators which operate the attachment, comprises means for sensing a configuration of the attachment, means for adjusting a pilot pressure of the working fluid fed to a plurality of manually operated main control valves in response to the sensed configuration, and means for fully reducing the pilot pressure of the working fluid, to a zero pressure, to the main control valves when the attachment has reached a predetermined configuration, whereby the main control valves assume their respective neutral positions, wherein the attachment is halted.

According to still another embodiment of the present invention, a device to control a mechanical linkage, using a main control valve controlling a working fluid fed to an hydraulic actuator that operates the linkage, the device comprising a manual operation valve for manually controlling a pilot pressure of the working fluid, in a pilot pressure feed line, fed to the main control valve, and an electromagnetic proportional control valve disposed in the pilot pressure feed line between the manual operation valve and the main control valve.

According to an embodiment of the present invention, a device to control a mechanical linkage, using a main control valve controlling a working fluid fed to an hydraulic actuator that operates the linkage, the device comprises a manual operation valve for manually controlling a pilot pressure of the working fluid, in a pilot pressure feed line, fed to the main control valve, an electromagnetic proportional control valve disposed in the pilot pressure feed line between the manual operation valve and the main control valve, means for sensing a configuration of the linkage, means for comparing the sensed configuration of the linkage to a predetermined configuration, means for causing the electromagnetic proportional control valve automatically to reduce the pilot pressure in the pilot feed line to the main control valve when the sensed configuration approaches the predetermined configuration, means for the controller to automatically cause the electromagnetic proportional control valve to reduce the pilot pressure to zero in the pilot feed line to the main control valve when the sensed configuration conforms to the predetermined configuration, and means to halt the linkage when the pilot pressure is zero.

According to another embodiment of the present invention, a device to control a mechanical linkage, using a main control valve controlling a working fluid fed to an hydraulic actuator that operates the linkage, the device comprises a manual operation valve for manually controlling a pilot pressure of the working fluid, in a pilot pressure feed line, fed to the main control valve, an electromagnetic proportional control valve disposed in the pilot pressure feed line between the manual operation valve and the main control valve, a controller which includes a data processor, means for sensing a configuration of the linkage, means for storing a predetermined configuration in the controller, means for comparing the sensed configuration of the linkage to the stored predetermined configuration in the controller, the controller having means for automatically causing the electromagnetic proportional control valve to reduce the pilot pressure in the pilot feed line to the main control valve when the sensed configuration approaches the stored predetermined configuration by a predetermined distance, the controller having means for automatically causing the electromagnetic proportional control valve to reduce the pilot pressure to zero in the pilot feed line to the main control valve when the sensed configuration conforms to the stored predetermined configuration, and means for the reduction of pilot pressure to zero to cause the linkage to halt.

According to an embodiment of the present invention, a control device to control a construction machine attachment, using a main control valve controlling a working fluid fed to an hydraulic actuator that operates the attachment, the control device comprises a manual operation valve to manually control a first pilot pressure of the working fluid, in a first pilot pressure feed line, fed to the main control valves, the first pilot pressure feed line passing through the manual operation valve, at least one alternate pilot pressure feed line, the alternate pilot pressure feed line being provided separately from the first pilot pressure feed line, the alternate pilot pressure feed line not passing through the manual operation valve, the alternate pressure feed line having an alternate pilot pressure, an electromagnetic proportional control valve effective to open or close proportionally according to an electric signal, thereby modulating the first pilot pressure or the alternate pilot pressure to yield a modulated pilot pressure, an electromagnetic change valve effective for selecting one of the electromagnetic proportional control valve and the manual operation valve, the electromagnetic change valve outputting the modulated pilot pressure or the first pilot pressure to at least one pilot chamber of the main control valve, at least one attachment sensor effective to detect a configuration of the attachment, means for comparing the configuration with a predetermined configuration, and means for causing the modulated pilot pressure to slow the attachment when the attachment approaches the predetermined configuration, the means for causing automatically halting the attachment when the attachment is at the predetermined distance.

According to an embodiment of the present invention, a control device to control a construction machine attachment, using a main control valve controlling a working fluid fed to an hydraulic actuator that operates the attachment, the control device comprises a manual operation valve to manually control a first pilot pressure of the working fluid, in a first pilot pressure feed line, fed to the main control valves, the first pilot pressure feed line passing through the manual operation valve, at least one alternate pilot pressure feed line, the alternate pilot pressure feed line being provided separately from the first pilot pressure feed line, the alternate pilot pressure feed line not passing through the manual operation valve, the alternate pressure feed line having an alternate pilot pressure, an automatic-mode selecting valve for selecting the alternate pilot pressure feed line when the attachment is operated in an automatic mode, an electromagnetic proportional control valve effective to open or close proportionally according to an electric signal, thereby modulating the first pilot pressure or the alternate pilot pressure to yield a modulated pilot pressure, an electromagnetic change valve effective for selecting one of the electromagnetic proportional control valve and the manual operation valve, the electromagnetic change valve outputting the modulated pilot pressure or the first pilot pressure to at least one pilot chamber of the main control valve, a controller which controls the automatic-mode selecting valve, the electromagnetic proportional control valve and the electromagnetic change valve with electrical signals, at least one attachment sensor effective to detect a distance information, of a distance moved by the attachment, and effective to input the distance information to the controller, manual operation sensors effective to detect operation information, of a condition of manual operation by the manual operation valve, and input the operation information to the controller, the controller comparing the distance information with a predetermined distance information stored in the controller, and the controller automatically causing the modulated pilot pressure to slow the attachment when the attachment approaches the predetermined distance, the controller automatically halting the attachment when the attachment is at the predetermined distance.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 3:
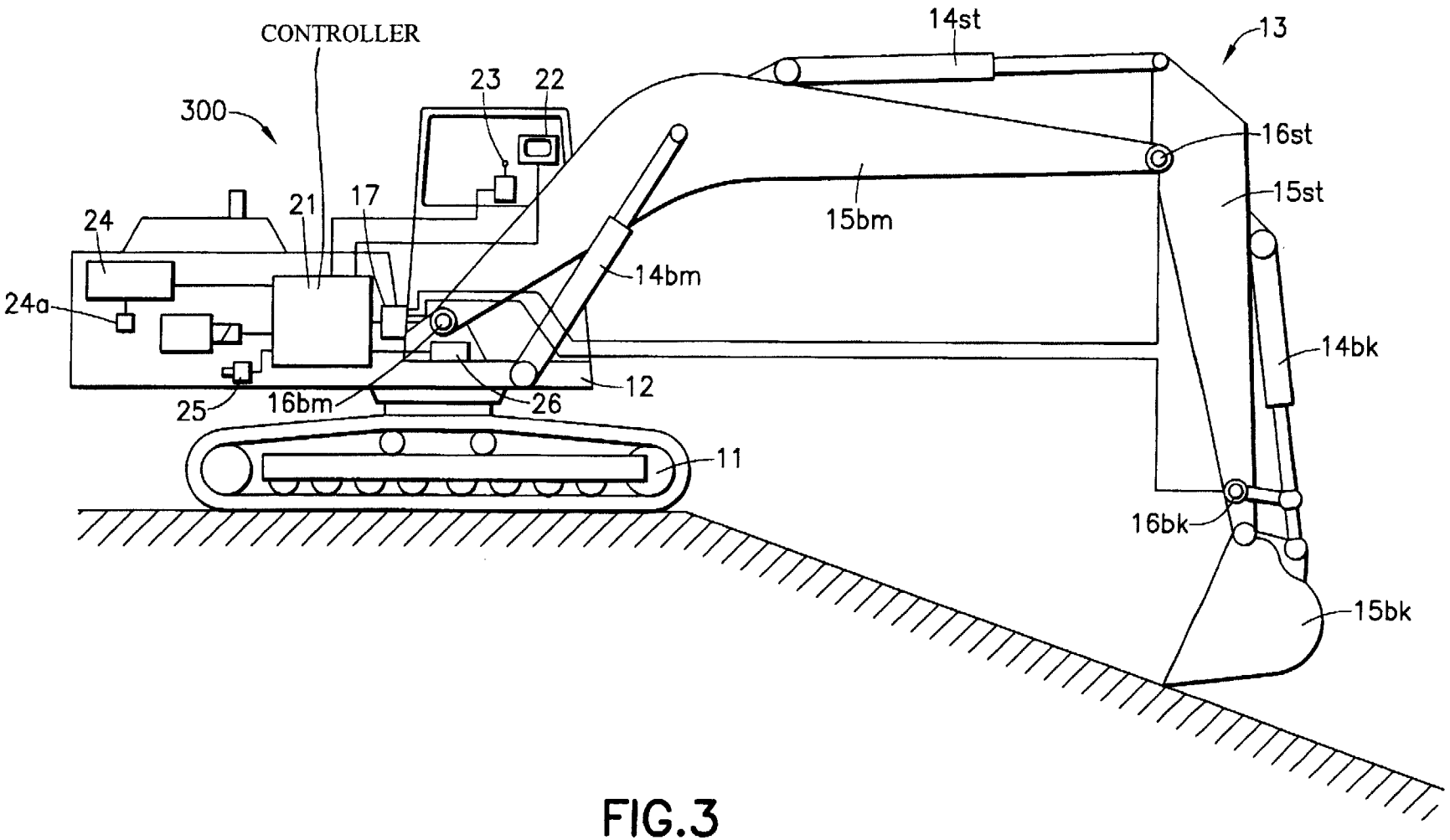
FIG. 3 is a system configuration of a hydraulic shovel equipped with a control device of the present invention.

FIG. 3 shows a system configuration of a hydraulic shovel 300 equipped with a control device for controlling the attachment of a construction machine according to the present invention. Hydraulic shovel 300 is provided with a lower structure 11 and an upper structure 12, which is mounted on lower structure 11 and has an attachment 13.

Attachment 13 is provided with a boom 15bm, a stick 15st and a bucket 15bk. Boom 15bm is swung, by being rotated about a pivot, by a boom cylinder 14bm and supported at its base end by upper structure 12 through a shaft. Stick lst is rotated by a stick cylinder 14st. The base portion of stick lst is joined to the front end of boom 15bm and is supported thereby through a shaft. Bucket l5bk is pivoted by a bucket cylinder 14bk and joined to the front end of stick 15st through a shaft, thus supported by stick 15st.

Boom cylinder 14bm, stick cylinder 14st and bucket cylinder 14bk are hydraulic actuators that operate attachment 13. Rotation or swing angles of boom 15bm, stick lst and bucket 15bk are each detected by respectively angle sensors 16bm, 16st, and 16bk. Angle sensors 16bm, 16st, and 16bk include, as an example, resolvers used as attachment sensors or any other convenient means.

Signals representing detected angles are sent by way of signal paths 70 through a signal transformer 17 mounted on upper structure 12 into a controller 21. Controller 21 includes a microcomputer.

Connected to controller 21 is a display switch panel 22 which serves as an input/output device, and members connected to the input of controller 21 include an engine pump controller 24, one or more pressure sensors 25, an inclination sensor 26, and a control switch 23 which is any convenient switch, for example, a push-button switch.

Control switch 23 is mounted on an operation lever or other suitable member and serves to initiate automatic control or to control the engine speed. Engine pump controller 24 controls an engine and a pump, based on the engine speed detected by an engine speed sensor 24*a*. Pressure sensors 25 detect the pressure of hydraulic circuits for driving attachment 13. Inclination sensor 26 detects an angle of inclination of the vehicle. Further, other electromagnetic valves, not shown, such as electromagnetic proportional control valves, electromagnetic change valves and similar valves, are connected to the output of controller 21.

Figure 4:
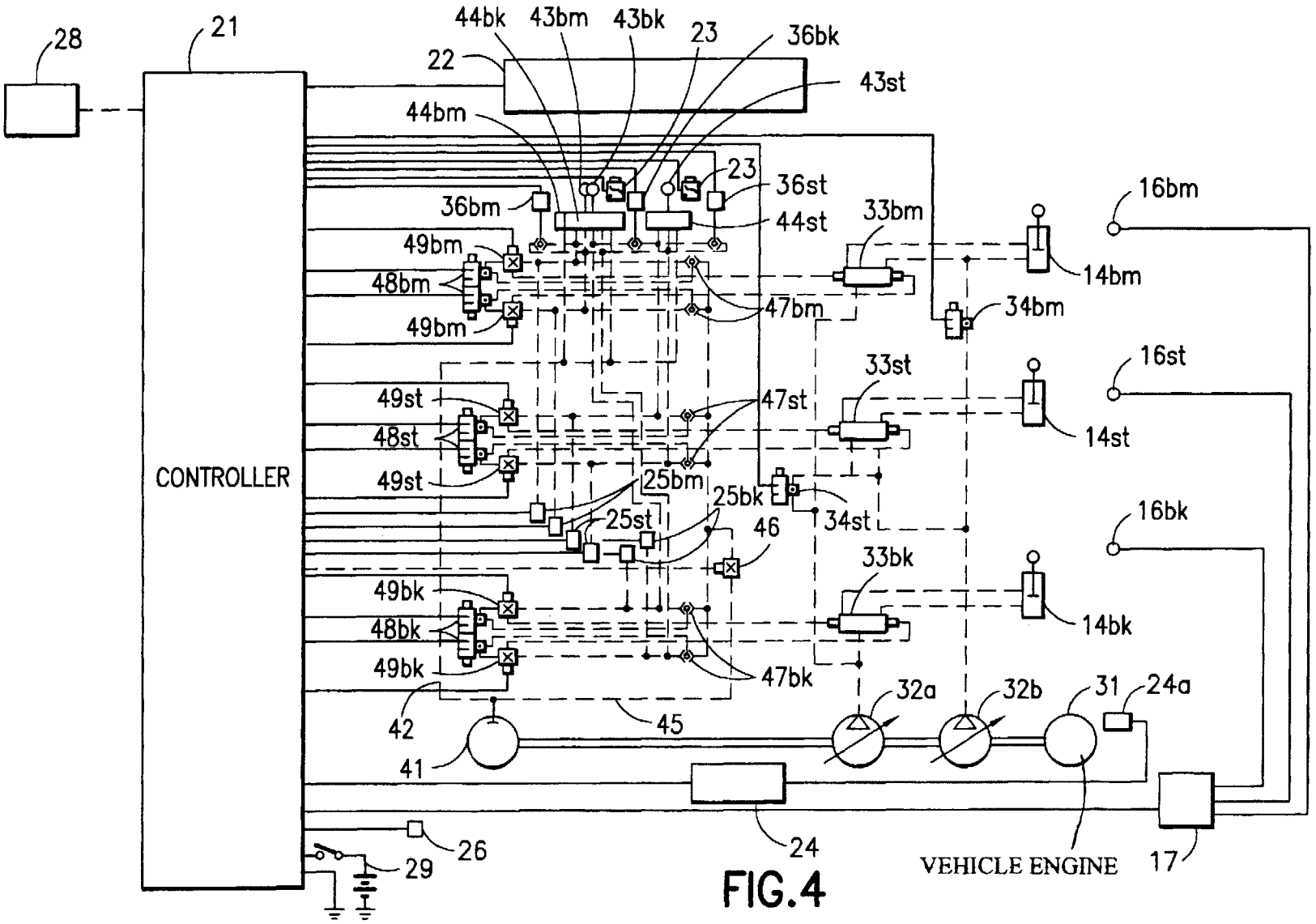
FIG. 4 is an electric/hydraulic circuit diagram showing an overall system configuration of a control device of the present invention.

FIG. 4 is a block diagram of an entire system of a control device of the present invention. FIG. 4 shows input lines that show the paths which bring various detected signals into controller 21, and output lines that show the paths which deliver output signals from controller 21 to drive various electromagnetic valves. Controller 21 has an external terminal 28 and a power circuit 29.

In FIG. 4, solid lines represent electric circuits and dotted lines represent hydraulic pressure circuits. Long broken lines represent a main hydraulic pressure circuit for driving the cylinders and short broken lines represent a pilot pressure circuit. Drain circuits are not shown.

The main hydraulic pressure circuit comprises a supply circuit for feeding hydraulic fluid from a first main pump 32*a* or a second main pump 32*b*, both of which are driven by a vehicle engine 31, to boom cylinder 14bm, stick cylinder 14st and bucket cylinder 14bk. The main hydraulic pressure circuit includes such pilot operated valves as a boom main control valve 33bm for the boom, a stick main control valve 33st for the stick and a bucket main control valve 33bk for the bucket.

Boom cylinder 14bm and stick cylinder 14st each require a high fluid flow rate. Hence, each is supplied fluid from both first main pump 32*a* and second main pump 32*b*. The circuits for feeding hydraulic fluid to boom cylinder 14bm and stick cylinder 14st are each provided with a boom converging electromagnetic proportional control valve 34bm and a stick converging electromagnetic proportional control valve 34st respectively. Each converging electromagnetic proportional control valve modulates one of the two feed lines to each cylinder. Thus, the converging fluid discharged from first main pump 32*a* and second main pump 32*b* to boom cylinder 14bm or stick cylinder 14st is modulated according to the required individual flow rate of each cylinder.

The pilot pressure circuit is provided with a pilot pump 41 which is driven together with first and second main pumps 32*a* and 32*b* by vehicle engine 31.

Manual boom operation valve 44bm, manual stick operation valve 44st, and manual bucket operation valve 44bk are proportional control valves for controlling the output pressure of pilot pump 41 and are connected to an output line 42 of pilot pump 41. Control of the output pressure of pilot pump 41 is conducted through manual operation of boom operation lever 43bm, stick operation lever 43st, and bucket operation lever 43bk for boom 15bm, stick 15st, and bucket 15bk respectively.

An automatic-mode selecting valve 46 for bypassing manual operation valves 44bm, 44st, and 44bk, in control of the aforementioned output pressure of pilot pump 41, is connected to an output line 45 which branches off from output line 42 of pilot pump 41.

Shuttle valves 47bm, 47st and 47bk are provided between the respective output lines of manual operation valves 44bm, 44st, 44bk, each together with the output line of automatic-mode selecting valve 46, and electromagnetic proportional control valves 48bm, 48st, and 48bk. In accordance with electrical signals, the respective pilot pressure from either manual operation valves 44bm, 44st, 44bk or automatic-mode selecting valve 46 are connected to the respective output lines of shuttle valves 47bm, 47st, 47bk.

Connected to each output line of electromagnetic proportional control valves 48bm, 48st, 48bk and the respective output lines of manual operation valves 44bm, 44st, 44bk are electromagnetic change valves 49bm, 49st, 49bk in order to select either electromagnetic proportional control valves 48bm, 48st, 48bk or manual operation valves 44bm, 44st, 44bk. The output pressure from the selected valve is directed to the respective pilot chamber of main control valves 33bm, 33st, and 33bk.

Automatic-mode selecting valve 46, electromagnetic proportional control valves 48bm, 48st, 48bk and electromagnetic change valves 49bm, 49st, 49bk are electromagnetic-operated valves that can be proportionally controlled. An example of an electromagnetic-operated valve is a spool valve, whose spool positions are controlled based on electrical signals from an output of controller 21.

Angle sensors 16bm, 16st, 16bk for detecting distance moved, i.e. angle of rotation, of the respective joints of attachment 13 are connected through signal transformer 17 to input terminals of controller 21. Also connected to input terminals of controller 21 are pressure switches 36bm, 36st, 36bk, as well as pressure sensors 25bm, 25st, 25bk, which serve as manual operation sensors to detect conditions of manual operation through the output lines of manual operation valves 44bm, 44st, 44bk.

Pressure sensors 25bm, 25st, 25bk detect analogously the quantity of changes of manual operation valves 44bm, 44st, 44bk, while pressure switches 36bm, 36st, 36bk detect on-off changes of manual operation valves 44bm, 44st, 44bk.

Figure 1:
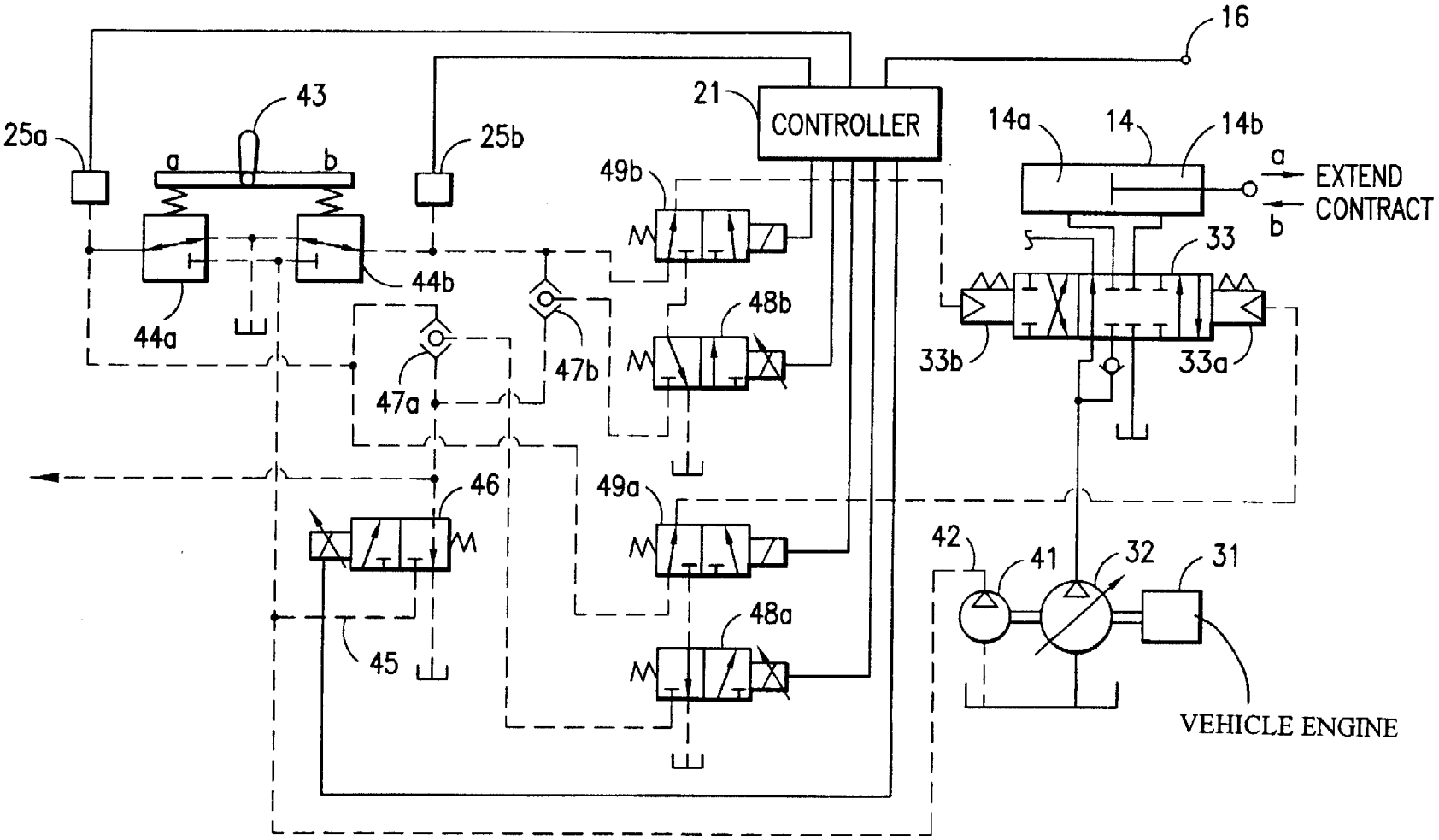
FIG. 1 is a hydraulic circuit diagram of a control device according to an embodiment of the present invention.

FIG. 1 is an enlarged view of one of the hydraulic cylinder control circuits of the attachment control device shown in FIG. 4. In FIG. 1, the elements corresponding to those in FIG. 4 are identified with the same reference numerals, but the elements on the cylinder-extended circuit are provided with the letter "a" and those on the cylinder-contracted circuit with the letter "b".

Referring to FIG. 1, connected to output line 42 of pilot pump 41 are a pair of manual operation valves 44*a*, 44*b* which control output pressure of the pilot pump by means of proportional reduction of the pressure through manual operation of operation lever 43.

Automatic-mode selecting valve 46 for bypassing manual operation valves 44*a*, 44*b* in control of the output pressure of the pilot pump is connected to output line 45 which branches off from output line 42 of pilot pump 41. Automatic-mode selecting valve 46 is an electromagnetic change valve.

Shuttle valves 47*a*, 47*b* are provided between the respective output lines of manual operation valves 44*a*, 44*b* and the output line of automatic-mode selecting valve 46. Electromagnetic proportional control valves 48*a*, 48*b* for controlling, in accordance with electrical signals from controller 21, the pilot pressure from either manual operation valves 44*a*, 44*b* or automatic-mode selecting valve 46 are connected to the respective output lines of shuttle valves 47*a*, 47*b*. Electromagnetic proportional control valves 48*a*, 48*b* are both electromagnetic proportioning pressure reduction valves.

Electromagnetic change valves 49*a*, 49*b* of an on/off operation type are respectively connected to the output lines of electromagnetic proportional control valves 48*a*, 48*b* and the output lines of manual operation valves 44*a*, 44*b*. These electromagnetic change valves serve to select either type of valves and send the pressure output to respective pilot chambers 33*a*, 33*b* of a main control valve 33.

When no pilot pressure is applied to pilot chamber 33*a* or 33*b*, main control valve 33 returns to a neutral position. In the example of using a spool valve as main control valve 33, the spool of main control valve 33 is returned to the neutral position by return springs at both sides of the spool.

An angle sensor 16, which detects a rotation angle of a joint of the attachment, and pressure sensors 25*a*, 25*b*, which detect pilot pressure through the output lines of manual operation valves 44*a*, 44*b*, are connected to input terminals of controller 21. Output terminals of controller 21 are connected to respective solenoids of automatic-mode selecting valve 46, electromagnetic proportional control valves 48*a*, 48*b* and electromagnetic change valves 49*a*, 49*b*.

The function of the circuit shown in FIG. 1 is explained with reference to FIGS. 2(A) and 2(B). FIG. 1 shows the state of the hydraulic circuit in the normal manual operation mode, wherein all the electromagnetic valves (valves 46, 48*a*, 48*b*, 49*a* and 49*b*) are off, that is, in a nonconductive state. Therefore, pilot pressure output from manual operation valve 44*a* or 44*b*, modulated according to the degree by which operation lever 43 has been operated, is applied through electromagnetic change valve 49*a* or 49*b* to pilot chamber 33*a* or 33*b* of main control valve 33. Consequently, working fluid from main pump 32 is fed through main control valve 33, which is opened to the degree corresponding to the aforementioned pilot pressure, to a head side 14*a* or a rod side 14*b* of a hydraulic cylinder 14 so that hydraulic cylinder 14 extends or contracts.

Figure 2A:
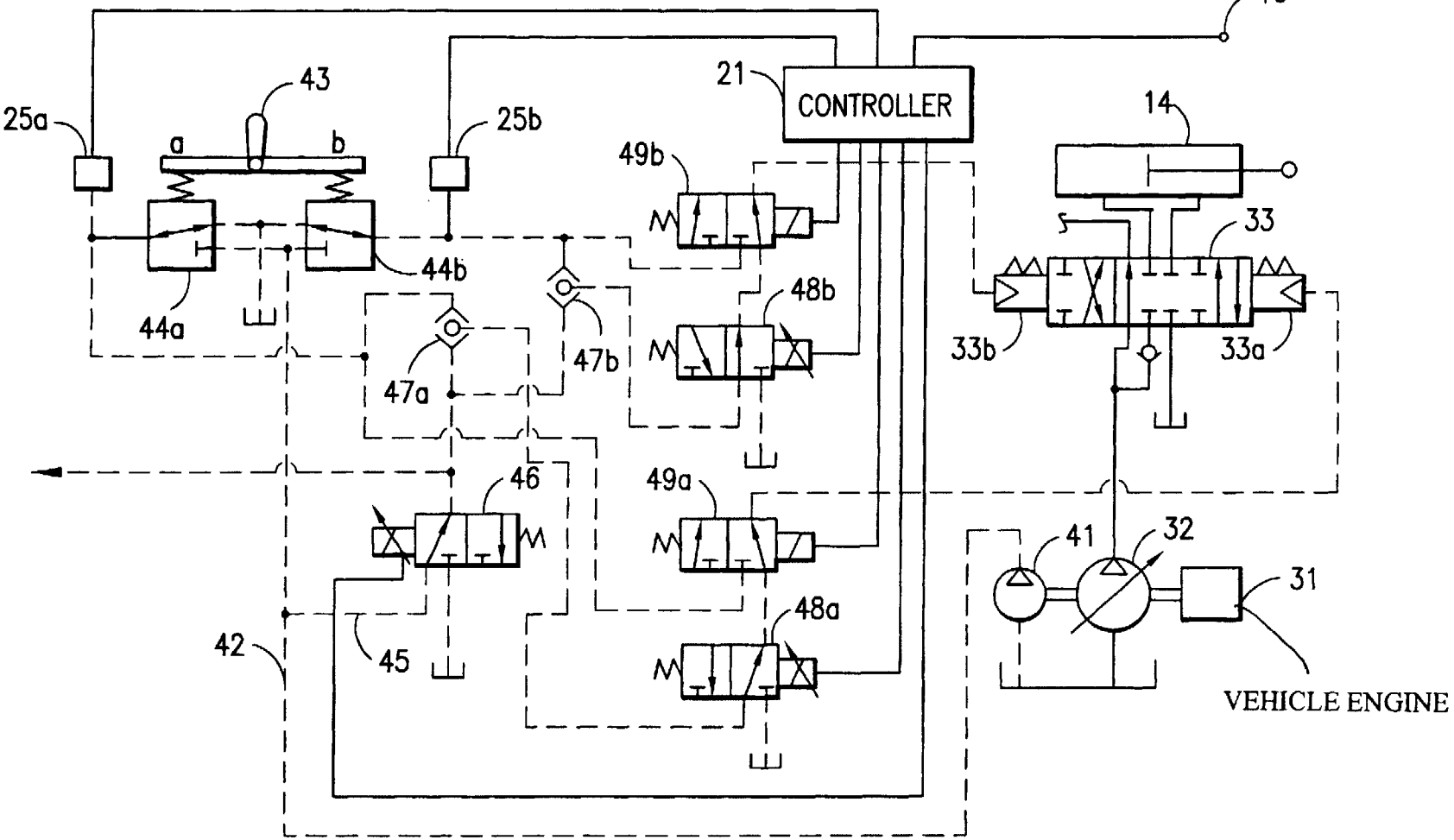
FIG. 2(A) is a hydraulic circuit diagram showing a state of the circuit of a control device of the present invention during automatic operation.
Figure 5A:
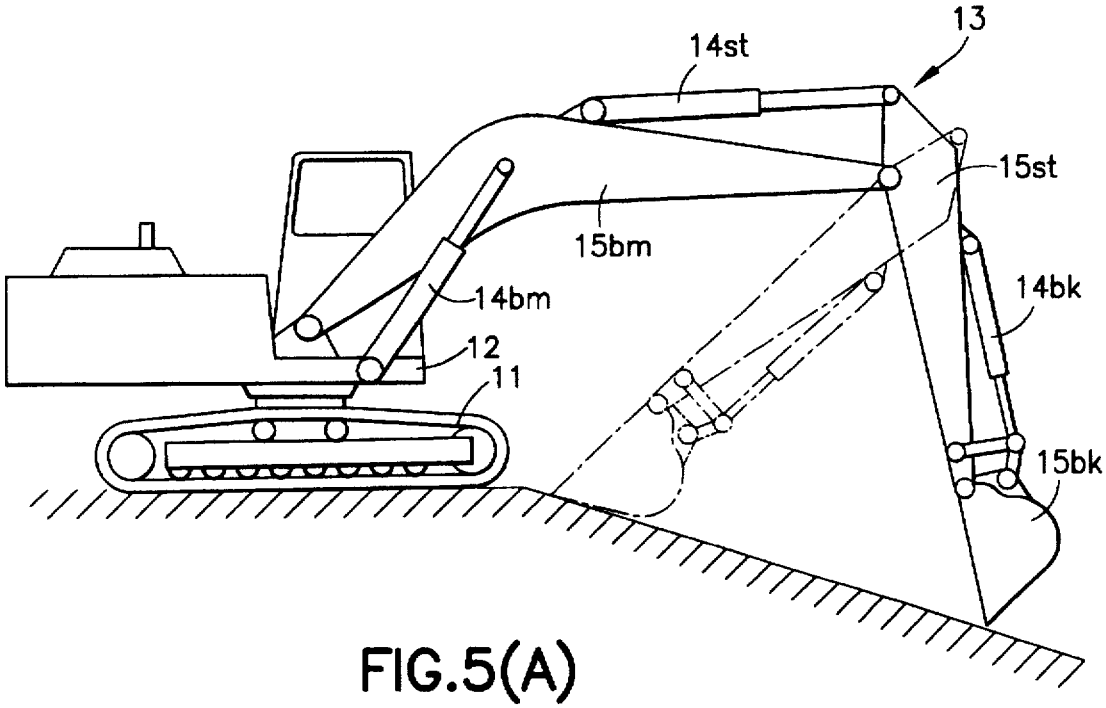
FIG. 5(A) is an explanatory drawing illustrating the straight line bucket tooth tip excavation mode controlled by a control device of the present invention.
Figure 5B:
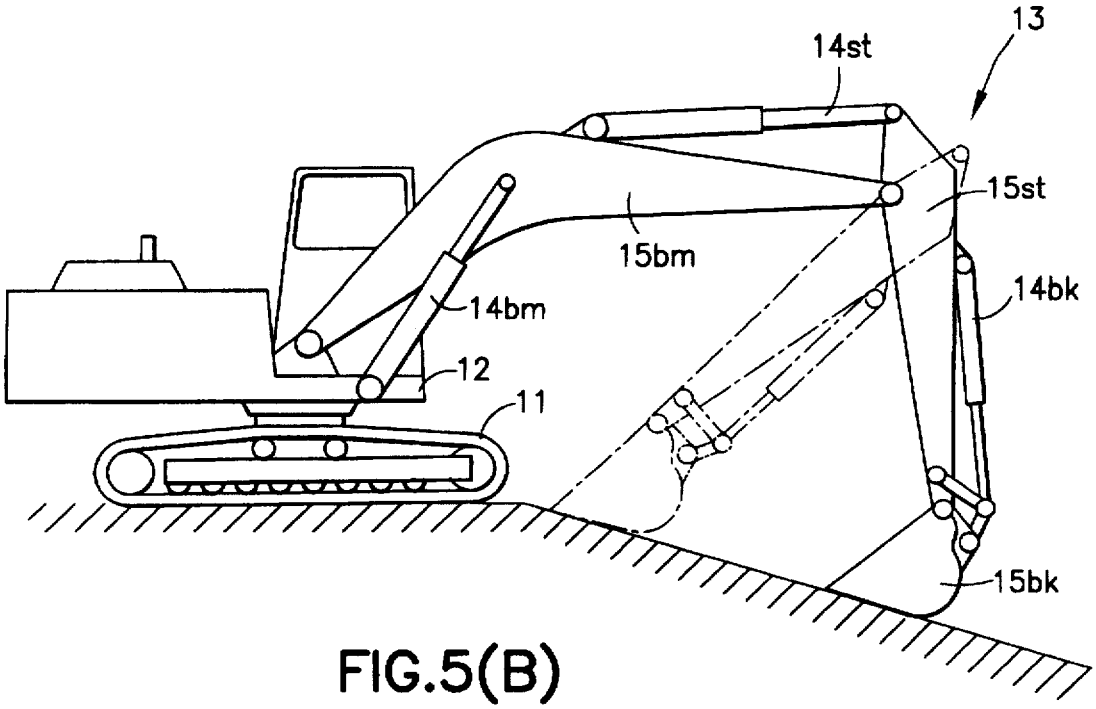
FIG. 5(B) is an explanatory drawing illustrating the operation in cases where the function for maintaining the angle of the bucket is added to the straight line excavation mode.

FIG. 2(A) shows the state of the hydraulic circuit under the straight line excavation mode wherein, as shown in FIG. 5(A), bucket 15bk is automatically moved in the process of excavation with the teeth of the bucket moving in a straight line, and the automatic excavation mode shown in FIG. 5(B), which is capable of straight line excavation combined with a function to maintain the bucket at a constant angle.

As shown in FIG. 2(A), while automatic excavation is performed, automatic mode selecting valve 46 and electromagnetic change valves 49*a*, 49*b* are all on in a conductive state. Hence, according to the degree of aperture of its spool in response to output signals from controller 21, electromagnetic proportional control valve 48*a* or 48*b* controls the pilot pressure, which has been fed from automatic-mode selecting valve 46 through shuttle valve 47*a* or 47*b*. As a result, orientation and degree of aperture of the spool of main control valve 33 are controlled through electromagnetic change valve 49*a* or 49*b*. Concurrently, the operation lever 43 is at the neutral position and no output pilot pressure is delivered from either manual operation valve 44*a* or 44*b*.

Figure 2B:
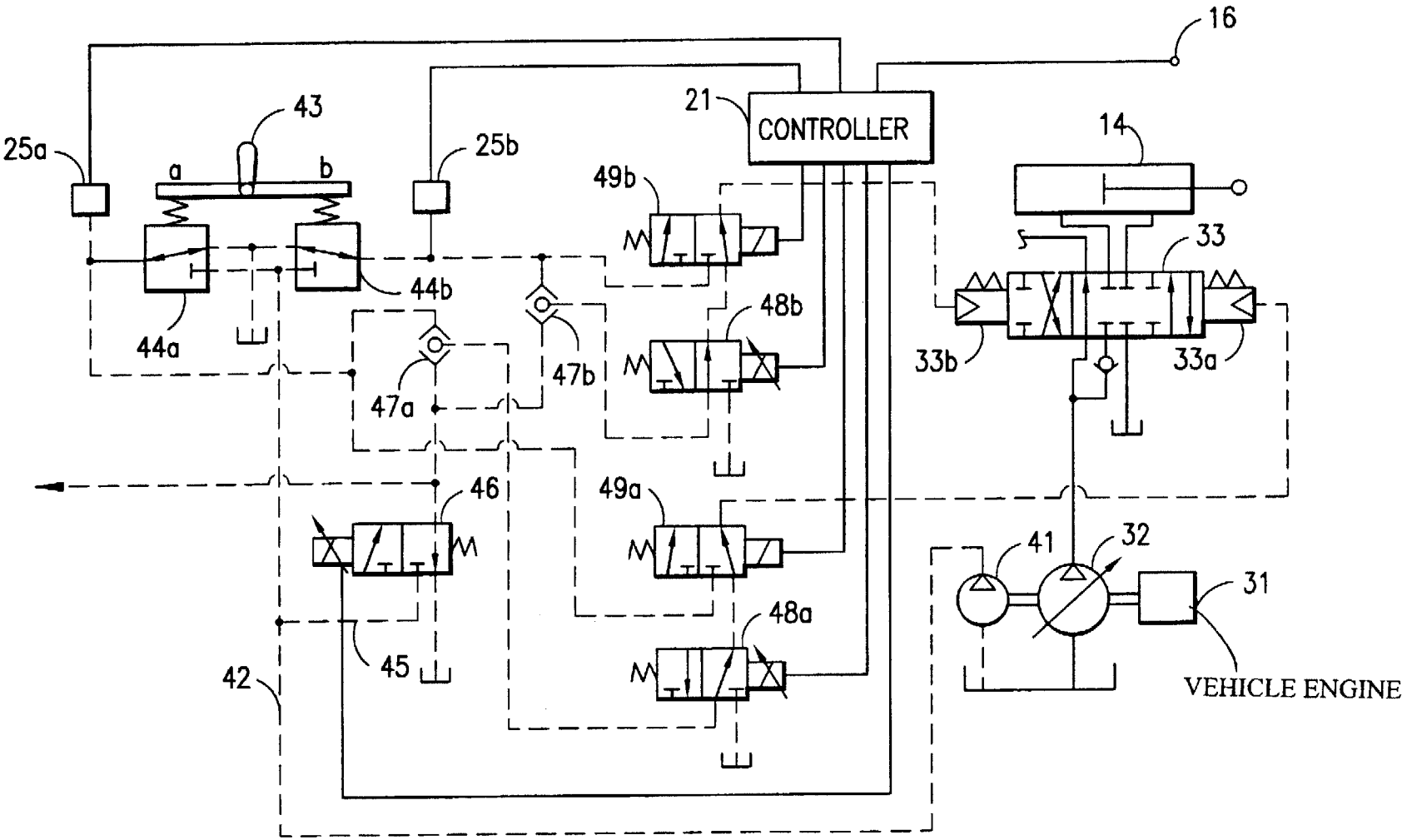
FIG. 2(B) is a hydraulic circuit diagram showing a state of the circuit of a control device of the present invention when controlling the limit of the operating range.

FIG. 2(B) shows the state of the hydraulic circuit in cases where the working range of attachment 13 is limited while in the manual operation mode. More precisely, it illustrates the hydraulic circuit in a case shown in FIG. 6 where the maximum height and digging depth of attachment 13 are limited when working in a tunnel or other similar environment, or a case shown in FIG. 7 where the length of the reach of attachment 13 with respect to a nearby wall is limited.

As shown in FIG. 2(B), during the operation range control mode in order to limit the operation range of the attachment, automatic-mode selecting valve 46 is in a nonconductive state, while electromagnetic change valves 49*a*, 49*b* are in a conductive state. Consequently, according to the degree of aperture of its spool in response to signals output from controller 21, electromagnetic proportional control valve 48*a* or 48*b* controls manual operation pilot pressure, which has been fed from manual operation valve 44*a* or 44*b* through shuttle valve 47*a* or 47*b*.As a result, orientation and degree of aperture of the spool of main control valve 33 are controlled through electromagnetic change valve 49*a* or 49*b*.

The spool of main control valve 33 can be displaced by, for example, pilot pressure supplied from manual operation valve 44*a* to pilot chamber 33*a* of main control valve 33. At that time, when the equipment is controlled to restrict its working range, where the spool of main control valve 33 has been displaced, the pressure in pilot chamber 33*a* is lowered by electric signals from controller 21 to the solenoid of electromagnetic proportional control valve 48*a* so that the springs are returned as shown in FIG. 1. As a result, the spool of main control valve 33 is returned to the neutral position, and the attachment stops.

Should either or both electromagnetic proportional control valves 48*a*, 48*b* fail during an automatic excavation operation as shown in FIG. 2(A) or operation with the limited attachment operation range as shown in FIG. 2(B), operation of the equipment can be continued manually by using a combination of valves comprising manual operation valves 44*a*, 44*b*, electromagnetic proportional control valves 48*a*, 48*b*, and electromagnetic change valves 49*a*, 49*b* so that the pilot pressure can be fed from manual operation valves 44*a*, 44*b* through electromagnetic change valves 49*a*, 49*b* to main control valve 33.

Even in the cases where all the electromagnetic valves are in the non-conductive state, the circuit according to the present embodiment has such a configuration that the springs of the valves are at the returned position so as to permit manual operation.

Figure 6:
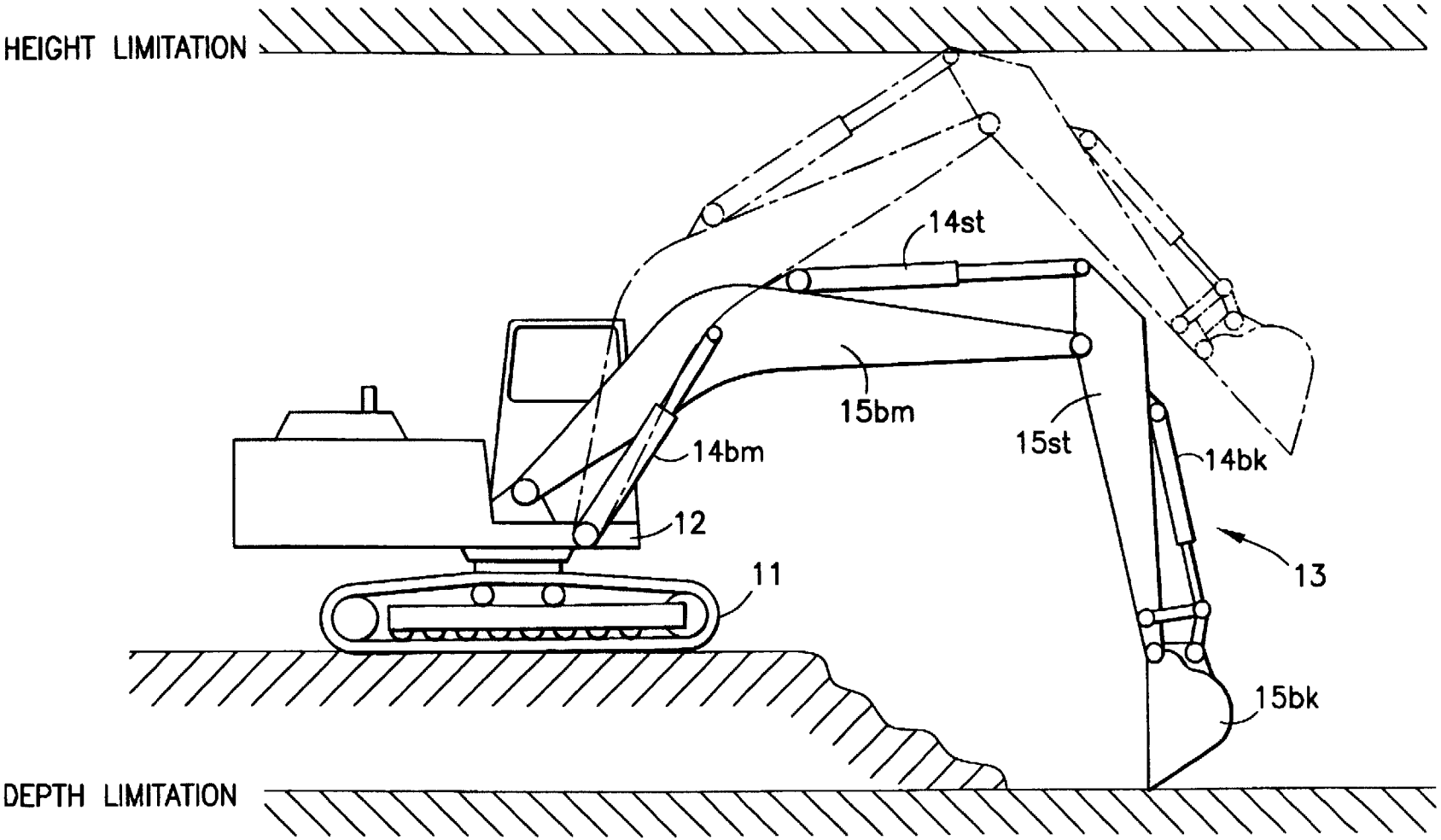
FIG. 6 is an explanatory drawing illustrating control of the height and the depth of the attachment by a control device of the present invention during manual operation.
Figure 7:
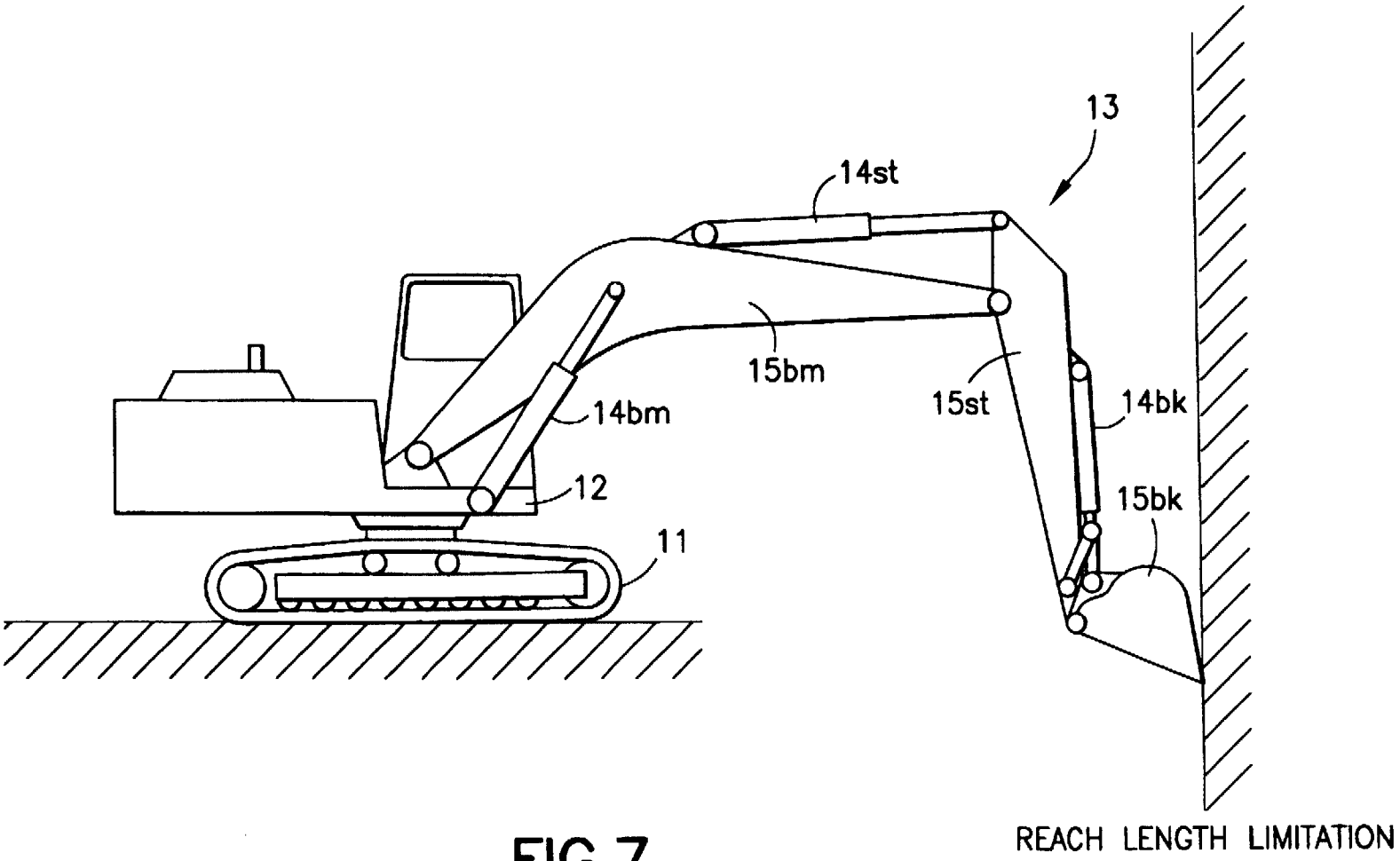
FIG. 7 is an explanatory drawing illustrating control of the reach of the attachment by a control device of the present invention during manual operation.
Figure 8:
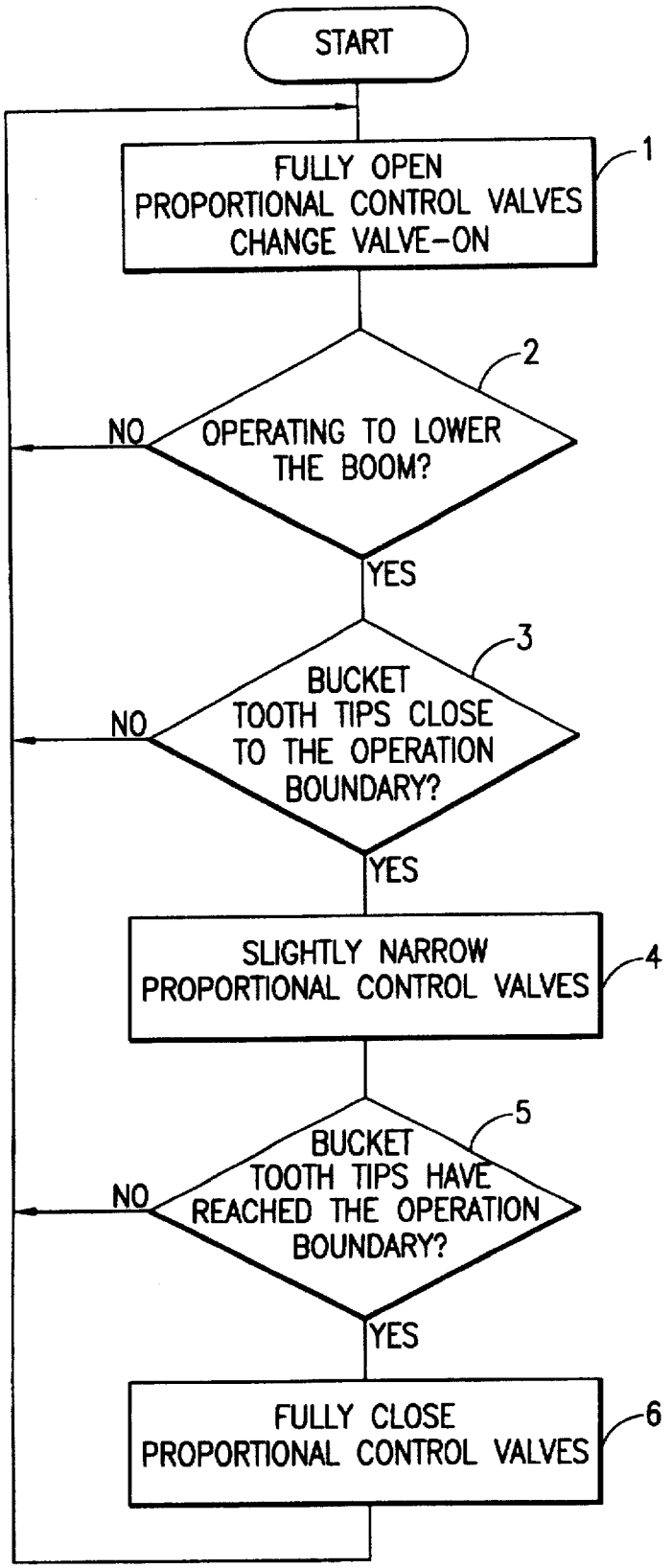
FIG. 8 is a flow chart showing a control method of the present invention.
Figure 9:
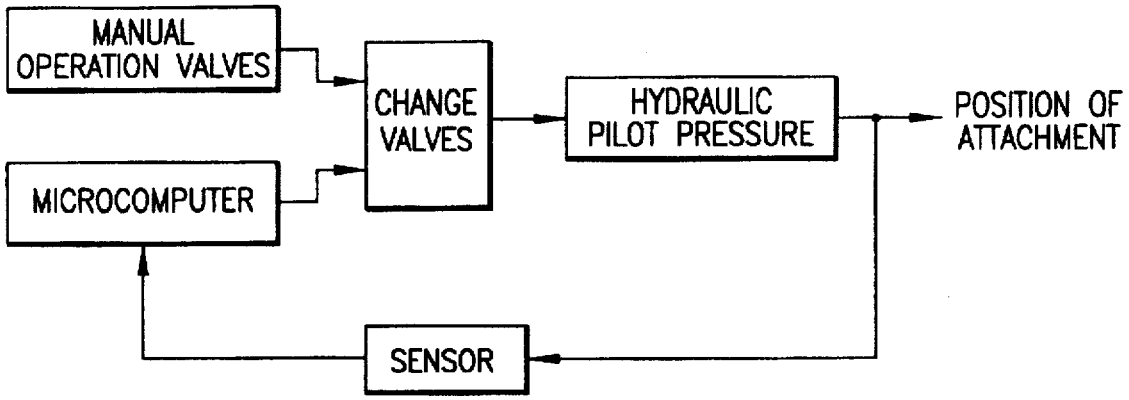
FIG.9 PRIOR ART
FIG. 9 is a circuit diagram of a conventional control device.

FIG. 8 is a flow chart of the procedure to control the lowering operation of boom 15bm when the lowest position of attachment 13 is limited as shown in FIG. 6.

Referring to the circuit diagram shown in FIG. 4 and the flow chart in FIG. 8, an example of the procedures to limit the lowering of boom 15bm includes the following steps as shown in FIG. 8:

Step (1): Turn on (open) electromagnetic change valve 49bm while fully opening electromagnetic proportional control valve 48bm.

Step (2): A decision is made, based on signals from pressure sensor 25bm, whether the operation is to lower boom 15bm by means of manual operation valve 44bm.

Step (3): If the operation is to lower the boom, another decision is made as to whether the tooth tips of bucket 15bk are close to the predetermined boundary to which operation of attachment 13 is limited (hereinafter referred to as the operation boundary). Consequently, the location of the tooth tips of bucket 15bk is constantly monitored by calculating using the respective rotation angles of boom 15bm, stick 15st and bucket 15bk as detected by angle sensors 16bm, 16st, 16bk. The angle sensors can be any convenient suitable devices such as resolvers.

Step (4): When the tooth tips of the bucket come close to the operation boundary, electromagnetic proportional control valve 48bm is slightly closed by a control current from controller 21. Consequently, the pilot pressure fed from manual operation valve 44bm through electromagnetic proportional control valve 48bm and electromagnetic change valve 49bm, on the boom-lowering side, is lowered. This reduces the pilot pressure into the boom lowering side pilot chamber of main control valve 33bm, thereby moving the spool of main control valve 33bm to its neutral position. The contraction of boom cylinder 14bm becomes slower as the quantity of working fluid fed from main control valve 33 to the rod-side of boom cylinder 14bm is reduced, which in turn slows down the lowering of boom 15bm.

The 4 control steps described above are repeated until the tooth tips of the bucket reach the operation boundary. Thus, by means of gradually narrowing the aperture of the spool of electromagnetic proportional control valve 48bm, the downward movement of boom 15bm is controlled to gradually slow down.

Step (5): During the above control operation, whether the tooth tips of the bucket have reached the operation boundary is constantly surveyed.

Step (6): When the tooth tips have reached the operation boundary, electromagnetic proportional control valve 48bm is completely closed, thereby completely eliminating the pilot pressure applied to the pilot chamber at the boom-lowering side of boom main control valve 33bm. As main control valve 33 is consequently returned by its springs to its neutral position, the lowering of boom 15bm is stopped.

Although the control procedure is explained as above referring to the control method to stop boom 15bm at the lowest limit in the lowering operation of the boom, the similar steps are applicable to other operations. Other examples in an attachment operation include cases such as when stopping boom 15bm at the highest limit in the elevation of the boom, stopping stick 15st at the inner or outer boundary during rotation of stick 15st and stopping bucket 15bk at the boundary during its opening or closing operation. Analogous operations are found in operations of other hydraulically controlled mechanical linkages such as, for example, operations of robotic arms.

Hence, as described above, even when a construction machine is being manually operated, a device and a method to control the construction machine attachment according to the present invention automatically control the working range of the attachment, thereby preventing the machine as well as a building and other objects near the machine from being damaged due to possible carelessness of the operator.

Therefore, the control device and method according to the invention are suitable to such cases that require operating such a construction machine as a hydraulic shovel, a loader, a back hoe and so forth at a small site which allows only a minimal working space.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

Although only a single or few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures. Thus although a nail and screw may not be structural equivalents in that a nail relies entirely on friction between a wooden part and a cylindrical surface whereas a screw's helical surface positively engages the wooden part, in the environment of fastening wooden parts, a nail and a screw may be equivalent structures.

What is claimed is:

1. A device to control a mechanical linkage, using a pilot operated main control valve that controls a working fluid fed to a hydraulic actuator which operates said mechanical linkage, comprising:

means for sensing a configuration of said linkage to produce a sensed configuration;

means for adjusting a pilot pressure of said working fluid fed to said pilot operated main control valve in response to said sensed configuration;

means for reducing said pilot pressure of said working fluid to a zero pressure when said mechanical linkage reaches a predefined configuration, whereby said pilot operated main control valve assumes a neutral position which halts motion of said mechanical linkage;

a manual operation valve for manually controlling said pilot pressure of said working fluid, in a pilot pressure feed line, fed to said main control valve;

said means for reducing said pilot pressure includes an electromagnetic proportional control valve disposed in said pilot pressure feed line between said manual operation valve and said main control valve;

means for storing a predetermined configuration and a predetermined tolerance of said mechanical linkage;

means for comparing said sensed configuration to said predetermined configuration; and means for causing said electromagnetic proportional control valve automatically to reduce said pilot pressure in said pilot feed line to said main control valve when said sensed configuration approaches said predetermined configuration by a predetermined tolerance.

2. A device to control a mechanical linkage according to claim 1 wherein said steps of sensing and comparing are repeated at least once.

3. A device to control a mechanical linkage, using a pilot operated main control valve that controls a working fluid fed to a hydraulic actuator which operates said mechanical linkage, comprising:

means for sensing a configuration of said linkage to produce a sensed configuration;

means for adjusting a pilot pressure of said working fluid fed to said pilot operating main control valve in response to said sensed configuration;

means for reducing said pilot pressure of said working fluid, to a zero pressure said mechanical linkage reaches a predefined configuration, whereby said pilot operated main control valve assumes a neutral position which halts motion of said mechanical linkage;

a manual operation valve for manually controlling said pilot pressure of said working fluid, in a pilot pressure feed line, fed to said main control valve;

an electromagnetic proportional control valve disposed in said pilot pressure feed line between said manual operation valve and said main control valve;

a controller which includes a data processor;

means for storing a predetermined configuration in said controller;

means for comparing said sensed configuration of said linkage to said stored predetermined configuration in said controller; said controller having means for automatically causing said electromagnetic proportional control valve to reduce said pilot pressure in said pilot feed line to said main control valve when said sensed configuration approaches said stored predetermined configuration by a predetermined distance; and said controller having means for automatically causing said electromagnetic proportional control valve to reduce said pilot pressure to zero in said pilot feed line to said main control valve when said sensed configuration conforms to said stored predetermined configuration thereby causing said linkage to halt.

4. A device to control a mechanical linkage according to claim 3 wherein said steps of sensing and comparing are repeated at least once.

5. A control device to control a mechanical linkage, using a pilot operated main control valve that controls a working fluid fed to a hydraulic actuator which operates said mechanical linkage, comprising:

means for sensing a configuration of said linkage to produce a sensed configuration;

means for adjusting a pilot pressure of said working fluid fed to said pilot operated main control valve in response to said sensed configuration;

means for reducing said pilot pressure of said working fluid, to a zero pressure when said mechanical linkage reaches a predefined configuration; whereby said pilot operated main control valve assumes a neutral position which halts said mechanical linkage;

said pilot pressure being at least one of a first pilot pressure and at least one alternate pilot pressure;

a manual operation valve to manually control said first pilot pressure of said working fluid, in a first pilot pressure feed line, fed to said main control valve;

said first pilot pressure feed line passing through said manual operation valve;

said at least one alternate pilot pressure being fed through an alternate pilot pressure feed line provided separately from said first pilot pressure feed line, said alternate pilot pressure feed line not passing through said manual operation valve;

an electromagnetic proportional control valve effective to open or close proportionally according to an electric signal, thereby modulating said first pilot pressure or said alternate pilot pressure to yield a modulated pilot pressure;

an electromagnetic change valve effective for selecting one of said electromagnetic proportional control valve and said manual operation valve, said electromagnetic change valve outputting said modulated pilot pressure to at least one pilot chamber of said main control valve;

said means for sensing includes at least one linkage sensor effective to detect a configuration of said linkage;

means for comparing said configuration with said predetermined configuration; and said means for reducing includes means for causing said modulated pilot pressure to slow said linkage when said linkage approaches said predetermined configuration, said means for causing automatically halting said linkage when said linkage is at said predetermined configuration.

6. A device to control a mechanical linkage, using a pilot operated main control valve that controls a working fluid fed to a hydraulic actuator which operates said mechanical linkage, comprising:

means for sensing a configuration of said linkage to produce a sensed configuration;

means for adjusting a pilot pressure of said working fluid fed to said pilot operating main control valve in response to said sensed configuration;

means for reducing said pilot pressure of said working fluid, to a zero pressure when said mechanical linkage reaches a predefined configuration; whereby said pilot operated main control valve assumes a neutral position thereby halting motion of said mechanical linkage;

said pilot pressure including a first pilot pressure and at least one alternate pilot pressure;

a manual operation valve to manually control said first pilot pressure of said working fluid, in a first pilot pressure feed line, fed to said main control valve;

said first pilot pressure feed line passing through said manual operation valve;

at least one alternate pilot pressure feed line, said alternate pilot pressure feed line being provided separately from said first pilot pressure feed line, said alternate pilot pressure feed line not passing through said manual operation valve, said alternate pressure feed line conveying said alternate pilot pressure;

an automatic-mode selecting valve for selecting said alternate pilot pressure feed line when said linkage is operated in an automatic mode;

said means for adjusting includes an electromagnetic proportional control valve effective to open or close proportionally according to an electric signal, thereby modulating said first pilot pressure or said alternate pilot pressure to yield a modulated pilot pressure;

an electromagnetic change valve effective for selecting one of said electromagnetic proportional control valve and said manual operation valve; said electromagnetic change valve outputting said modulated pilot pressure or said first pilot pressure to at least one pilot chamber of said main control valve;

a controller which controls said automatic-mode selecting valve, said electromagnetic proportional control valve and said electromagnetic change valve;

said means for sensing includes at least one linkage sensor effective to detect a distance information, of a distance moved by said linkage, and effective to input said distance information to said controller;

manual operation sensors effective to detect operation information, of a condition of manual operation by said manual operation valve, and input said operation information to said controller;

said controller comparing said distance information with a predetermined distance information stored in said controller; and said controller automatically causing said modulated pilot pressure to slow said linkage when said linkage approaches said predetermined distance, said controller automatically halting said linkage when said linkage is at said predetermined distance.

* * * * *